United States Patent [19]

Blotenberg

[11] Patent Number: 4,831,535

[45] Date of Patent: May 16, 1989

[54] METHOD OF CONTROLLING THE SURGE LIMIT OF TURBOCOMPRESSORS

[75] Inventor: Wilfried Blotenberg, Dinslaken, Fed. Rep. of Germany

[73] Assignee: Man Gutehoffnungshuette GmbH, Fed. Rep. of Germany

[21] Appl. No.: 940,980

[22] Filed: Dec. 12, 1986

[30] Foreign Application Priority Data

Dec. 18, 1985 [DE] Fed. Rep. of Germany ..... 3544822

[51] Int. Cl.[4] ..... F04D 27/02; G04B 13/02

[52] U.S. Cl. ..... 364/431.02; 415/1; 415/17

[58] Field of Search ..... 364/431.02, 494; 415/1, 415/15, 17

[56] References Cited

U.S. PATENT DOCUMENTS

| | | | |
|---|---|---|---|
| 3,963,367 | 6/1976 | Stalker et al. | 415/17 |
| 4,139,328 | 2/1979 | Kuper et al. | 415/1 |
| 4,156,578 | 5/1979 | Agar et al. | 415/17 |
| 4,164,033 | 8/1979 | Glennon et al. | 364/431.02 |
| 4,464,720 | 8/1984 | Agarwal | 364/431.02 |
| 4,594,051 | 6/1986 | Gaston | 364/431.02 |
| 4,656,589 | 4/1987 | Albers et al. | 364/431.02 |
| 4,697,980 | 10/1987 | Keyes, IV et al. | 415/1 |

*Primary Examiner*—Parshotam S. Lall
*Assistant Examiner*—Ellis B. Ramirez
*Attorney, Agent, or Firm*—McGlew & Tuttle

[57] ABSTRACT

A method and apparatus for controlling the surge limit of a turbocompressor utilizes continuously measured pressure and temperature values at the suction and outlet sides of the compressor. A relief valve connected to the outlet side of the compressor is controlled as a function of the distance between a working point and a surge limit line or blow-off line of a characteristic graph produced by characteristic graph coordinates that are computed using the pressure and temperature values. The actual value of another operating parameter that is independent of the pressure and the temperature values, such as the speed of the turbine for the turbocompressor, for example, is used. This operating parameter defines a family of characteristic lines on the characteristic graph. A set-point value for the characteristic graph coordinates is then obtained using the characteristic line of the operating parameter which passes through the working point. If the set point value thus found does not correspond to the actual value for the operating parameter, a control signal is generated which can either be used to influence the relief valve or for generating a warning signal.

18 Claims, 3 Drawing Sheets

METHOD OF CONTROLLING THE SURGE LIMIT OF TURBOCOMPRESSORS

FIELD AND BACKGROUND OF THE INVENTION

The present invention relates in general to the field of turbocompressors, and in particular to a new and useful method of controlling the surge limit of such turbocompressors.

Such a method is known from "Nachrichten für den Maschinenbau" (News for Machine Builders")* 5/82.
*English title of the paper: "Machinery News"

An instable turbocompressor state in which pumped medium flows from the compression or outlet side back to the suction side in surges or peridically is called surge. Surge occurs when the end pressure is too high and/or the throughput too low. In a characteristic field or graph for a compressor which is defined by end pressure and throughput or by coordinates derived therefrom, it is possible, to unequivocally define a line which separates the stable from the instable zone. This line or curve is called the surge limit. Controlling the surge limit of the compressor is necessary to prevent the compressor's working point from reaching the surge limit, thereby causing surges. Towards this end a blow-off line is established in the characteristic graph at a safety distance from the surge limit. If the working point crosses the blow-off line, a relief valve branched off the compressor outlet is opened more or less to blow off pumped or compressed medium or reorient it to the suction side, thereby lowering the end pressure or increasing the throughput.

The surge limit curve and, hence, the blow-off curve are fixed in the characteristic graph unequivocally, unchangeably, and independently of the momentary operating state when the adiabatic head $\Delta h_{ad}$ and the volume of the suction flow $\dot{V}$ are used as characteristic graph or field coordinates. From the continuously measured compressor operating variables, in particular suction and end pressure, and from the pressure difference at a throttling point on the suction side, these coordinates can be computed by the formulas:

$$\Delta h_{ad} = R \cdot z \cdot T_1 \frac{\kappa}{\kappa - 1} \left[ \left( \frac{P_2}{P_1} \right)^{\frac{\kappa - 1}{\kappa}} - 1 \right] \quad (1)$$

$$\dot{V} = K \cdot R \cdot z \sqrt{\frac{\Delta P \cdot T_1}{P_1}} \quad (2)$$

in which $P_1$ is the suction pressure, $P_2$ the end pressure $\Delta P$ the pressure drop at a throttling point on the suction side and $T_1$ the temperature on the suction side, these values being present as constantly monitored measured values. $R_1$ is the gas constant and $\kappa$ (kappa) is the isentropic index of the respectively pumped gas, while K is a constant depending upon the geometry of the throttling point in the compressor intake. The letter z represents a constant factor (real gas factor).

In the characteristic field defined by $\Delta h_{ad}$ and $\dot{V}$, the location of the surge limit and, hence, also of the blow-off $$\Delta h_{ad} = R \cdot z \cdot T_1 \frac{\kappa}{\kappa - 1} \left[ \left( \frac{P_2}{P_1} \right)^{\frac{\kappa - 1}{\kappa}} - 1 \right]$$

line, is independent of chnges of the parameters contained in the formulas (1) and (2). However, computing these characteristic field coordinates from the measured pressures and the temperatures is possible only if R, $\kappa$ (kappa) and K are known. At a given, unchangeable compressor geometry and at unchangeable pumped gas composition, these variables R, $\kappa$, and K can be measured once and then treated as constants. But a change in the pumped gas composition can result in a change of the associated values for R and/or $\kappa$. The changes are not directly measurable, however. In such a case, sticking by the previous values for R and $\kappa$ would lead to a wrong computation of the characteristic field coordinates so that the surge limit curve would also be incorrect in a characteristic field so computed. The situation is similar if the effective compressor geometry is altered, e.g. by dirt.

If the surge limit control is based on such an incorrect surge limit curve and hence, an incorrect blow-off line in the characteristic field, the consequence is either that surging is not prevented with certainty or that opening the relief valve is already triggered at too great a safety distance from the real surge limit, which can lead to undesirably high power losses of the compressor.

SUMMARY OF THE INVENTION

It is an object of the invention to provide a method of controlling the surge limit in the manner described above, but which makes it posible to acquire the effects upon the surge limit of the characteristic field used, which are caused by changes in the gas composition and/or by e.g. contamination-related changes of the compressor geography and to make appropriate corrections in the surge limit control.

Accordingly, an object of the present invention is to provide a method for controlling the surge limit of a turbocompressor in which characteristic field coordinates of the momentary compressor working point are computed by continuously measuring pressure and temperature values at the suction and outlet side of the compressor and wherein the opening and the closing of a relief valve connected to the outlet of the compressor is controlled as a function of the distance between the surge limit line and the blow-off line in the characteristic field, wherein the actual value of an operating parameter which defines a group of characteristic lines in the characteristic field is continuously measured, the parameter being selected so that it is independent of the pressure and temperature values measured at the suction and outlet sides of the compressor, finding a set-point value for the operating parameter which is associated with one of the characteristic lines going through the working point, a set-point value being taken at the characteristic field coordinates and being compared with the actual measured value for the operating parameter, and, if the actual value deviates from the set-point value of the operating parameter, generating a correction signal for influencing the control of the relief valve and/or for activating a warning.

A further object of the present invention is to provide a control apparatus which can be used to practice the method.

The starting point of the inventive solution for the above-stated problem is that each working point in the stable characteristic field zone has its own characteristic line for other parameters such as speed, blade position, power output, etc. so that there is a clear relationship between the characteristic field coordinates and the parameters. Accordingly, by way of a computed or measured characteristic field, an associated set-point value e.g. of the compressor speed n can be determined from the characteristic field coordinates computed according to the above equations (1) and (2). If the actual measured speed deviates from this set-point value, this means that the actual working point also deviates from the working point computed by the equations (1) and (2) because one or more of the variables R, $\kappa$ and K have changed. The deviation between set-point value and actual value of the speed or of another characteristic parameter such as blade position or compressor power thus serves as a correction variable which indicates that the actual surge limit curve deviates in the characteristic field from the presumed curve. If based on a modified gas composition, for instance, this deviation can be taken into account by an appropriate correction within the computation of the characteristic field coordinates per equation (1) for the determination of the control variables or by directly superposing an appropriate correction variable on the control. On the other hand, by operating the compressor with a standard gas having known values for R and $\kappa$ it can be determined whether a deviation between set-point and actual speed indicates a contamination of the compressor system. In this case, appropriate servicing or stopping of the system can be initiated by a warning signal.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

FIELD AND BACKGROUND OF THE INVENTION

The invention is explained below in greater detail with reference to the drawings in which.

DESCRIPTION OF THE PREFERRED EMBODIMENTS

Figure 1:
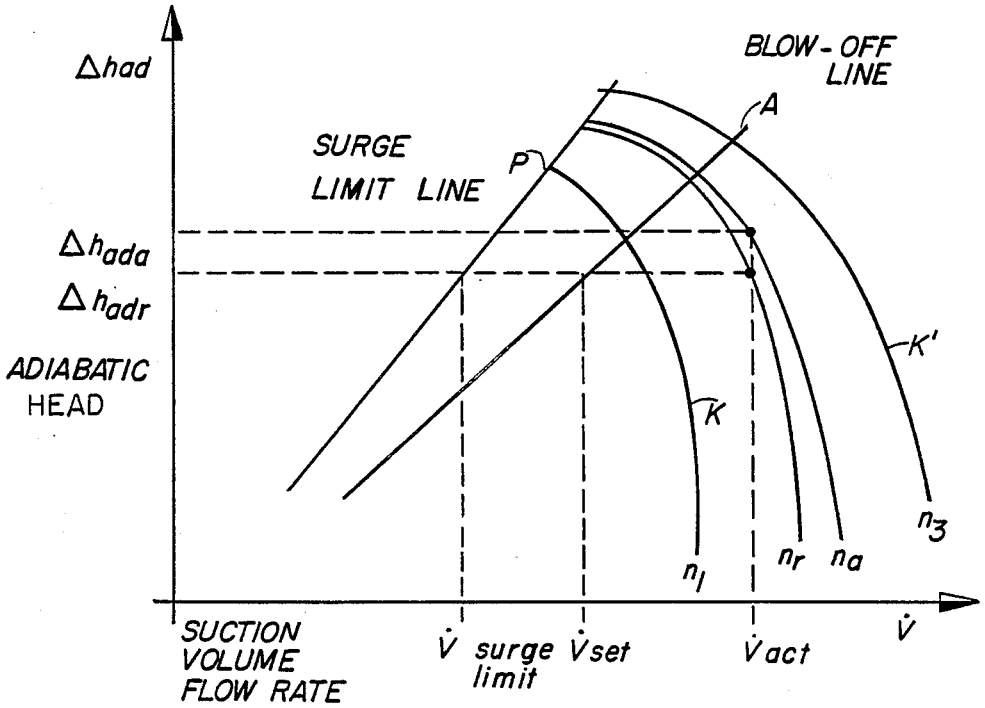
FIG. 1 is a generalized representation of a characteristic graph of field of a compressor with surge limit, blow-off line and characteristic curves of constant speeds.

The surge limit P of a compressor is clearly defined in the characteristic field with the coordinates $\dot{V}$ and $\Delta h_{ad}$, as shown in FIG. 1. The location of the surge limit is independent of changes in the parameters of suction pressure, end pressure, temperature, gas constant or isentropic index.

While variables like pressures and temperatures are readily measurable, the gas constant R and the isentropic index are not directly measurable. In any case, they are not measurable in a fast or economical way. Gas analyses often require considerable time so that the analysis results are available too late and are useless for the control of the relief valve. The method according to the invention is capable of detecting and taking into account changes in these variables and presupposes that in the variation of the gas composition there is always a unequivocal relation between isentropic index. $\kappa$ and gas constant R.

The method may also be used, when only one parameter, $\kappa$ or R, is changed. This is included in above statement, however should be expressed separately.

For example, this is always assured when the gas composition is modified by admixing a gas of constant composition or when several gases are admixed which have similar gas constants or isentropic indices. It may be stated quite generally that the method is applicable whenever an unequivocal relation between the gas constant R and the isentropic index $\kappa$ exists for all occurring gas compositions.

According to the invention, a standard gas composition is assumed where R and $\kappa$ have a given, known value. Now, for this standard gas the head $\Delta h_{ad}$ and the suction flow volume $\dot{V}$ are computed as characteristic field coordinates from the measured values, independent of the actual gas composition. The mathematical value $\Delta h_{adr}$ and $\dot{V}_r$ are obtained from the formulas (1) and (2).

If gas of a deviating composition is used, the actual values for $\Delta h_{ada}$ and $\dot{V}_a$ will vary from the computed values $\Delta h_{adr}$ and $\dot{V}$r.

According to FIG. 1, a characteristic line K, K' of constant speed $n_1$, $n_2$ etc. runs exactly through each working point with the coordinates V and $\Delta h_{ad}$. Therefore, an unequivocal, mathematical speed $n_r$ also corresponds to the mathematical values $\Delta h_{adr}$ and $V_r$. The equation:

$$\frac{\Delta h_{ad}}{\Delta h_{ad}'} = \frac{n^2}{n'^2} \tag{3}$$

also applies, and according this equation, a speed $n_a$ corresponds to the actual head $\Delta h_{ada}$ and the actual throughput $\dot{V}_a$.

This speed is the actually measured speed which is measurable very accurately and very easily by measuring the drive turbine speed.

Figure 2:
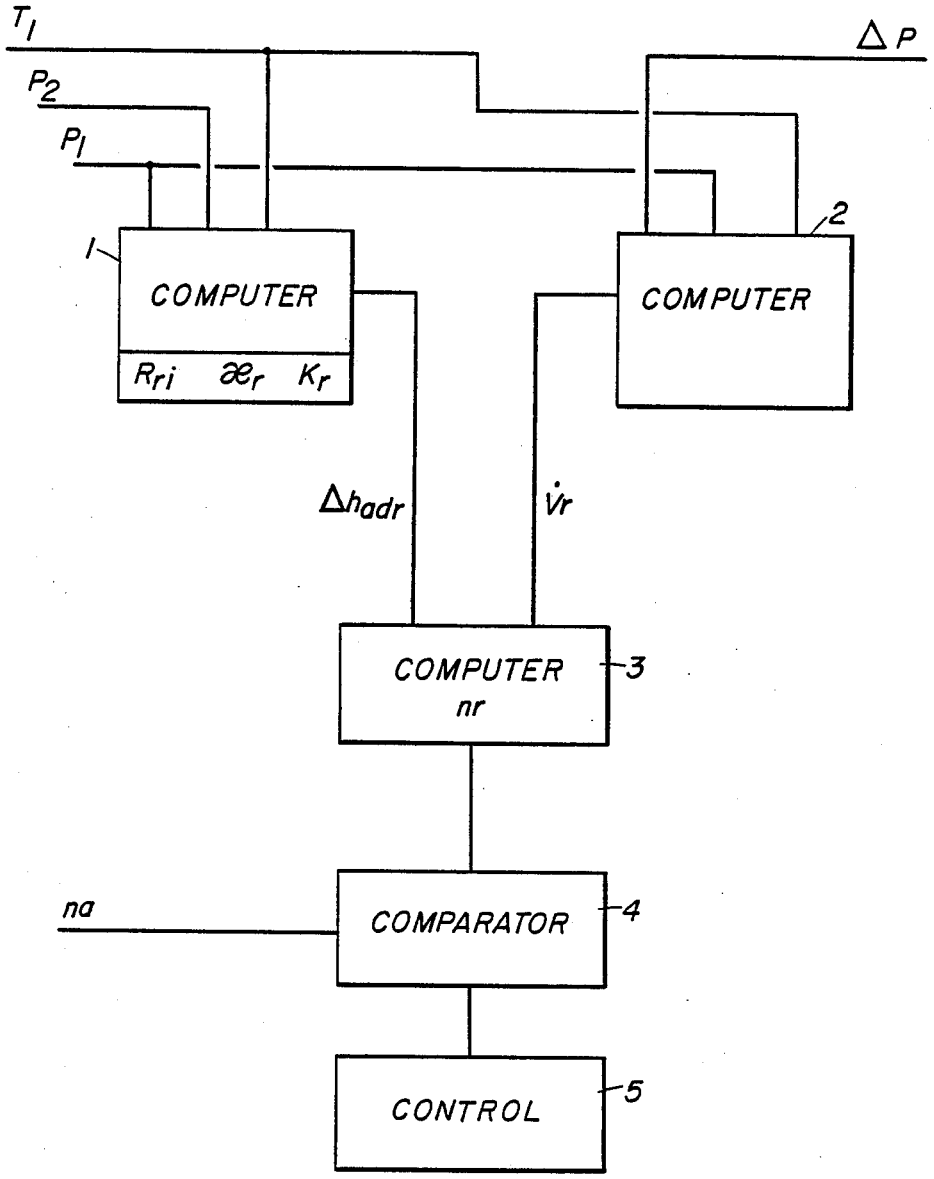
FIG. 2 is a schematic represesentation of the mathematical components used to practice the invention.

Assuming further that the characteristic compressor field ($\Delta h_{ad}$ over V) was determined mathematically or experimentally, and is known, and also assuming that the isentropic index $\kappa$ is an unequivocal function of the gas constant R ($\kappa$=F(R)), all data needed to determine $\kappa$ are known. According to FIG. 2, this is done as follows:

With the help of $R_r$ and $\kappa_r$, a computer 1 determines from the variables P1, P2, T1 the theoretical head in the nomal state ($\Delta h_{adr}$). From the pressure drop $\Delta$ p, the suction pressure p1 and the suction temperature T1 as well as from the standard gas constant $R_r$, the computer 2 determines the theoretical volumetric flow Vr. In the computer 3, the characteristic compressor curve is displayed either in the form of mathematical equations or in the form of a matrix with the respective theoretical speed $n_r$. The computer 3 either computes the mathematical speed $n_r$ or reads it directly from the matrix memory.

This mathematical speed is now compared in the comparator 4 with the actually measured speed $n_a$. If the actual speed coincides with the mathematical speed, the actual gas composition will also coincide with the standard composition. But if the measured speed deviates from the mathematical speed, a different gas composition is present. Then, the relation of the blow-off line A given in the characteristic field, does not coincide with the actual working conditions either, and the surge limit control does not work properly. This must be corrected by taking the changed gas composition into account. Comparator 4 thus can change the set point in the controllers.

A possible, but very difficult approach would be to compute by way of the formulas (1) and (2) and from the known relationship between R and $\kappa$ the variable $R_a$ and $\kappa_a$, i.e. the actual gas constant and the actual isentropic index. These values for R and $\kappa$ can then be inserted for $\Delta h_{ad}$ and $\dot{V}$ in the formulas to obtain the actual head and the actual throughput. These two variables can be looked on as actual and set-point values to a conventional surge limit control which protects the compressor against surging.

According to FIG. 1, this control may work as follows, for instance: A computer determines the actual head of the compressor according to the $\Delta h_{ad}$ formula. The permissible minimum suction flow $\dot{V}_{set}$ is determined therefrom by reflection from the blow-off line A. This is compared with the actually measured throughput $\dot{V}_{act}$. As long as the measured throughput $\dot{V}_{act}$ is greater than the permissible minimum $\dot{V}_{set}$, the blow-off valve remains closed. Only upon exceeding $\dot{V}_{set}$, will the blow-off valve open.

A simpler possibility of taking into account changes in the gas composition consists in concluding empirically from the deviation of the speeds that the surge limit has shifted, and accordingly shifting the blow-off line automatically. Such a method will be described in greater detail in the following.

By putting into a surge limit control as described above only the normal state data instead of the correct data for $\kappa$ and R, an error will result if the gas composition deviates from the normal. A wrong head and a wrong throughput will be computed. Surging of the compressor will occur at a point other than the surge limit P defined in FIG. 1. The actual surge limit shifts as function of the difference between the actual gas condition and the normal condition. This shift clearly depends upon the variation of the gas composition. Since $\kappa$ is an unequivocal function of R, as assumed above, this shift is unequivocal also. Since it was determined in addition that the speed deviation between the mathematical speed $n_r$ and the actual speed $n_a$ depends exclusively upon the gas composition, the speed deviation is also an unequivocal measure of the surge limit shift.

Figure 3:
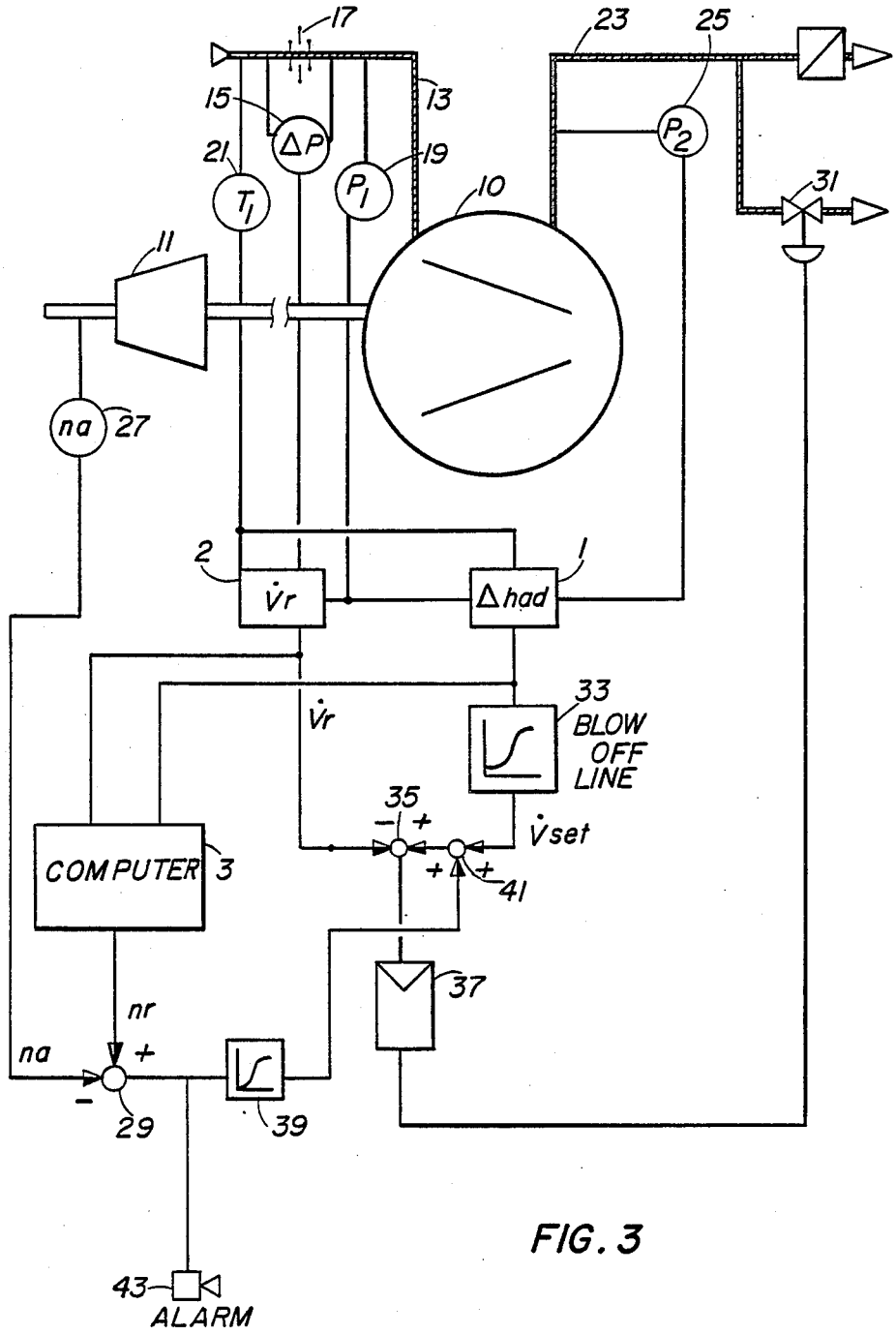
FIG. 3 is a complete schematical representation of the surge limit control system of a compressor.

As a rule, this influence is non-linear so that it is self suggesting to feed the speed deviation to a function generator and have the function generator output control the blow-off line shift. The easiest way to realize this is to determine the theoretical surge limit curve at various gas compositions and to plot it graphically. The speed deviation is determined also, and a function generator is set to this relation. FIG. 3 is a schematic diagram of such a surge limit control.

A compressor 10 is driven by a turbine 11 or by another variable speed driver. A transducer 15 in the suction line 13 measures the pressure difference (pressure drop) at a throttling point 17, and a pressure sensor 19 measures the suction pressure and a temperature sensor 21 the temperature on the suction side. From these variables, the mathematical suction throughput $V_r$ is determined in the computer 2 (see FIG. 2), using the gas constant $R_r$ for the normal gas composition. A pressure sensor 25 determines the end pressure at the compressor outlet 23, and therefrom as well as from the variables measured on the suction side the computer 1 determines the head $\Delta h_{,adr}$, using $R_r$ and $\kappa_r$ for the normal pumped gas composition. In a computer or matrix memory 3 the mathematical speed $n_r$ belonging to $\dot{V}_r$ and $\Delta h_{adr}$ at normal gas composition is determined. This is compared in a differential element 29 with the actual speed $n_a$ measured at the shaft of the turbine 11 by means of a speed sensor 27.

$\dot{V}_r$ and $\Delta h_{adr}$, computed by the computers 1 and 2, also serve as control variables for the control of a relief valve 31 branched off the compressor outlet 23. The head $\Delta h_{adr}$ is fed to a function generator 33 in which the blow-off curve is stored. For each $\Delta h_{adr}$ value the function generator 33 generates the associated set-point value $\dot{V}_{set}$ of the suction flow (see FIG. 1), fixed by the blow-off line A. This output $\dot{V}_{set}$ of the function generator 33 is compared in a differential element 35 with the actual value $\dot{V}_r$, and therefrom a control difference whose output signal opens the relief valve 31 when the blow-off line A in the characteristic field is crossed so that surging is prevented by lowering the end pressure and/or increasing the throughput through the compressor.

The output signal of the differential element 29 is fed to a function generator 39 which, on the basis of the deviation of the mathematical speed $n_r$ from the actual speed $n_a$, generates a fixed correction signal which takes into account the nonlinear relation between the speed deviation and the required correction of the surge limit or blow-off line in the characteristic field per FIG. 1. The correction signal generated by the function generator 39 is added by a summer 41 to the set-point value $V_{set}$ generated by the function generator 33 so as to match the control of the relief valve to the changed gas composition.

Modifications and further developments of the embodiments described are possible within the scope of the invention. For example, the correction signal generated by the function generator 39 may also be added to the actual $\dot{V}_r$ value generated by the computer 2 or to the control difference generated by the differential generator 35. It is further possible to add the correction signal to the control signal not purely additively, but multiplicatively or additively and multiplicatively at the same time. Additive adding means a parallel shift, multiplicative adding means a rotation of the surge limit P or blow-off line A in the characteristic field of FIG. 1.

In case of the control of a multistage compressor system, it is possible to apply the method described not to all stages, but only to one or several stages.

Instead of the speed, other parameters may also be utilized which unequivocally define a characterstic line going through the respective working point. Such a parameter is, for instance, the vane position, especially in compressors operated at constant speed and controlled by altering the vane position. It is possible, furthermore, to use the compressor's power intake instead of the speed.

As mentioned at the outset, it is possible with the method according to the invention to detect and take into account not only changes in the gas composition, but also changes in the compressor geometry caused e.g. by contamination. The compressor is then operated with a gas of standard composition whose values for R and $\kappa$ are known and identical with the data used in the computers 1 and 2. In that case, the set-point value $n_r$ and the actual value $n_a$ should be identical so that no output signal appears at the differential element 29. If signal appears from the differential element 29 nevertheless, it may be concluded therefrom that the compressor geometry has changed, e.g. by dirt. In that case, the signal generated by the diferential element 29 can be utilized to activate a warning signal transmitter 43 which furnishes an indication that the compressor must be serviced or even be stopped in the presence of danger.

Should a gas of normal composition ($R_r$, $\kappa_r$) not be available, this check can also be made with another gas of known R and $\kappa$ values. In this case, a deviation between $n_a$ and $n_r$ will appear in the differential element 29 also if the compressor is clean.

In a separate computation outside of the arrangement shown in FIG. 3 this deviation for a clean compressor must be determined by the method described above. A comparison of the mathematically determined deviation with the output signal of the differntial element 29 will show whether contamination or another modification of the compressor geometry is present.

While specific embodiments of the invention have been shown and described in detail to illustrate the application of the principles of the invention, it will be understood that the invention may be embodied otherwise without departing from such principles.

What is claimed is:

1. A method of controlling a gas conveying turbocompressor having a suction side, an outlet side and a relief valve connected to the outlet side which can be opened and closed as a function of the distance between a working point and at least one of a surge limit line and a blow-off line which are plotted on a characteristic graph, the turbocompressor operating at a momentary working point lying at a point in the characteristic graph, the blow-off line and surge limit line of the characteristic graph being plotted using predetermined theoretical coordinates which are a function of theoretical flow parameters including suction gas temperature, suction gas pressure, volumetric flow rate, outlet gas pressure and gas composition at the suction and outlet sides of the compressor, the method comprising:

continuously measuring the suction gas pressure and suction gas temperature at the suction side and outlet gas pressure at the outlet side of the compressor;

calculating the actual characteristic graph coordinates at the gas composition using the continuously measured pressures and tempertures representing a momentary working point of the turbocompressor;

continuously measuring the actual value of the speed of the compressor, which is used to define a family of characteristic lines on the characteristic graph;

obtaining a set point value for the speed on the characteristic graph using a characteristic line generated by the speed which passed through the momentary working point of the compressor as it appears on the characteristic graph;

comparing the actual value of the speed to the set point value therefor; and generating a correction signal indicating a change in gas composition if the actual value of the monitoring parameter deviates from the set point value therefor.

2. A method according to claim 1, including using the correction signal to control the opening and closing of the relief valve by changing an input signal to a surge limit controller.

3. A method according to claim 1, including using the correction signal to activate a warning device.

4. A method according to claim 1, wherein the calculated actual characteristic graph coordinates comprise adiabatic head and volumetric suction flow for the compressor.

5. A method according to claim 1, wherein the actual characteristic graph coordinates which are calculated using the pressures and temperatures comprise adiabatic head and volumetric suction for the compressor.

6. A method according to claim 1, including operating the compressor using a working gas at a selected time, operating the compressor using a standard gas at another time, a known actual value being established for the standard gas, and generating a control signal if, while using the standard gas in the compressor, the actual value of the speed deviates from the known actual value for the speed which was established for the standard gas, due to changes in compressor geometry or compressor datas.

7. A method according to claim 1, wherein the speed is measured whenever there is a change in the composition of a gas being pumped by the compresor, the correction signal being generated when there is a deviation between the actual value and the set point value for the speed.

8. A method according to claim 1, wherein the actual value of one characteristic graph coordinate is compared with a set point value for that characteristic graph coordinate, the actual and set point values for the one characteristic graph coordinate being obtained at a single value for the other characteristic graph coordinate, obtaining a control difference between the actual and set point values for the one characteristic graph coordinate, using the control difference to control the opening and closing of the relief valve, and modifying the control signal which is obtained by comparing the actual value to the set point value to the speed, using the control diference.

9. A method according to claim 8, wherein the correction signal & additively influences the controlled signal.

10. A method according to claim 8, wherein the correction signal multiplicatively influences the control signal.

11. An apparatus for controlling a gas conveying turbocompressor having a suction side, an outlet side and a relief valve connected to the outlet side which can be opened and closed the turbocompressor operating at a momentary working point and having a surge limit line and a blow-off line on a characteristic graph having characteristic theoretical graph coordinates which are calculated based on theoretical flow parameters at the suction and outlet sides of the compressor, the apparatus comprising:

pressure and temperature sensors for sensing the temperature and pressure values at the suction and outlet sides of the compressor;

first calculating means connected to the sensor for calculating one of the actual characteristic graph coordinates;

second calculator means connected to the sensors for calculating a second actual characteristic graph coordinate;

means for comparing one of said first and second actual characteristic graph coordinate with the blow-off line and outputting a set point signal representing a theoretical corresponding characteristic graph coordinate; means for comparing said set point signal with the other of said one of said first and second actual characteristic graph coordinates to produce a control input signal;

a monitoring parameter sensor for sensing a parameter of the compressor which is independent of the pressures and temperatures sensed by the pressure and temperature sensors;

third calculator means connected to the monitoring parameter sensor for calculating a family of characteristic lines on the characteristic graph, one of which passes through the working point of the compressor; and means for comparing the actual monitoring parameter as measured by the monitoring parameter sensor with a monitoring parameter set point for the monitoring parameter which is taken from a characteristic line of the monitoring parameter on the characteristic graph which passes through the working point and outputting a correction signal representative of the difference; means for combining said control input signal with said correction signal;

control means for generating a control signal based on said input control signal and said correction signal for opening and closing the relief valve.

12. An apparatus according to claim 11, wherein the monitoring parameter sensor comprises a speed sensor for sensing the speed of the compressor, the first calcultor means calculating the adiabatic head of the compressor and the second calculator means calculating the suction flow volume of the compressor.

13. An apparatus according to claim 11, wherein: said means for combining said input control signal and said correction signal includes means for adding said correction signal to said set point signal.

14. A method of controlling the pumping limit of a gas conveying turbocompressor having a suction side, an outlet side and a relief valve connected to the outlet side which can be opened and closed with the turbocompressor operating at a momentary working point and having a surge limit line and a blow-off line which are plotted on a characteristic graph, the momentary working point of the compressor lying at a point in the characteristic graph, the blow-off line and surge limit line of the characteristic graph being plotted using predetermined theoretical coordinates which are calculated as a function of theoretical flow parameters measured including suction gas temperature, suction gas pressure, volumetric flow rate, outlet gas pressure and gas composition at the suction and outlet sides of the compressor, the method comprising:

continuously measuring the suction gas pressure and suction gas temperature at the suction side and outlet gas pressure at the outlet side of the compressor;

calculating the actual characteristic graph coordinates using the continuously measured pressures and temperatures representing a momentary working point of the turbocompressor;

comparing one of the coordinates of the calculated characteristic graph coordinates with one of the blow-off line and the sure limit line on the characteristic graph to obtain a set point value corresponding with the calculated graph coordinate;

comparing said set point value corresponding to the calculated characteristic graph coordinate with another calculated characteristic graph coordinate to form a controller input signal; controlling the relief valve based on said controller input signal;

continuously measuring the actual value of the speed of the compressor, which monitoring parameter is used to define a family of characteristic lines on the characteristic graph;

obtaining a set point value for the speed on the characteristic graph using a characteristic line generated by the speed which passed through the momentary working point of the compressor as it appears on the characteristic graph;

comparing the actual value of the speed to the set point value therefor; and generating a correction signal if the actual value of the monitoring parameter deviates from the set point value therefor thereby indicating a change in the composition of the conveyed gas.

15. A method according to claim 14, wherein: said correction signal is additively combined with said control input signal.

16. A method according to claim 14, wherein: said correction signal is multiplicatively combined with said input control signal.

17. A method according to claim 14, wherein: said correction signal is combined with said set point signal to influence said control input signal.

18. A method according to claim 14, further comprising: shifting said blow-off line in dependence upon the value of said correction signal.

* * * * *